United States Patent [19]

Winckler

[11] 4,045,860

[45] Sept. 6, 1977

[54] METHOD OF ASSEMBLING AN AEROSOL DISPENSER

[75] Inventor: Richard Winckler, Ville D'Avray, France

[73] Assignee: Cebal, Paris, France

[21] Appl. No.: 684,260

[22] Filed: May 7, 1976

[30] Foreign Application Priority Data

| | | |
|---|---|---|
| May 7, 1975 | France | 75.14928 |
| Feb. 20, 1976 | France | 76.05316 |

[51] Int. Cl.[2] ..... B23P 11/02

[52] U.S. Cl. ..... 29/451; 29/509; 29/522; 113/120 P; 220/63 R; 222/94; 222/386.5; 222/394

[58] Field of Search ..... 29/509, 522, 451; 113/120 P, 120 H, 120 Z; 220/63 R; 222/94, 386.5, 394

[56] References Cited

U.S. PATENT DOCUMENTS

| | | | |
|---|---|---|---|
| 2,847,959 | 8/1958 | Switzer | 220/63 R X |
| 3,378,169 | 4/1968 | Clark | 222/94 X |
| 3,477,195 | 11/1969 | Chambers | 222/394 X |
| 3,677,211 | 7/1972 | Miller et al. | 113/120 P X |
| 3,700,136 | 10/1972 | Ruekberg | 220/63 R |
| 3,995,572 | 12/1976 | Saunders | 113/120 H |

*Primary Examiner*—Charlie T. Moon
*Attorney, Agent, or Firm*—Dennison, Dennison, Meserole & Pollack

[57] ABSTRACT

An aerosol dispenser including an outer casing, a product containing bag within said casing and sealingly secured thereto at a point of interconnection between the casing and a cap carrying a dispensing valve. Pressurized propellant is disposed between the casing and the bag.

5 Claims, 9 Drawing Figures

METHOD OF ASSEMBLING AN AEROSOL DISPENSER

This invention relates to a process and apparatus for assembling aerosol dispensing containers and more particularly, to barrier type aerosol containers wherein the product to be dispensed is contained within a separate receptable disposed within the main body of the container. Dispensers of this type ordinarily include a rigid external casing supporting a flexible internal container, preferably of plastic material, although thin lightweight metal inner containers are equally acceptable. The upper edge of the inner container, hereinafter referred to as a bag, is flanged to define a rim which extends over and is secured to the mouth of the external container. A cap member carrying a distribution valve is usually mounted on the external container with appropriate dispensing elements projecting into the bag in contact with the contents for selective discharge thereof. The base of the external container or casing generally includes a sealable opening for the introduction of a propellant.

BACKGROUND OF THE INVENTION

Aerosol dispensers of the type contemplated by this invention have also been referred to as two-chamber aerosol containers, barrier packages or pocket aerosols. The annular chamber between the outer wall of the bag and the inner wall of the external container or casing is filled with a propellant usually in the form of a pressurized gas. The consumer product may, for example, be a cosmetic product, a perfume, insecticides, paints, or the like, or food products. To dispense the product, the distribution valve is opened and the pressure exerted by the propellant on the product through the medium of the bag expels the same via the distribution valve.

SUMMARY OF THE INVENTION

The aerosol casing comprises a base, a cylindrical wall terminating in a shoulder or dome and may be fabricated from a single or a plurality of individual components. The shoulder terminates in a mouth defined by a collar in the form of a torus or a rolled edge. The mouth is generally closed by means of a metallic cap surmounting a distribution valve. The cap includes a radial skirt terminating in a peripheral flange configured to overlie the collar of the casing for crimping attachment thereto. More specifically, in one technique, the cap may be secured to the casing by shaping a portion of the cap against the internal face of the collar. The shaping force being exerted beneath the level of the collar thus drawing the cap downwardly against the upper face of the collar. Impermeability between the flange of the cap and the collar of the casing is generally ensured by an elastic joint or seal positioned between the flange of the cap and the upper face of the collar.

In barrier aerosols, the internally disposed product containing bag is generally secured to the outer casing at the seating level of the cap on the collar with the bag being suspended by the collar within and generally along the axis of the aerosol casing. To enable this method of securement to be effected, the upper portion of the bag includes a throat whose outside diameter is generally less than that of the internal diameter of the mouth of the casing. The throat of the bag terminates at its upper extremity in a rim of such configuration that on the one hand, it can be inserted into the flange of the cap, and, on the other hand, can rest on the upper edge of the collar of the casing.

During the seating of the cap, the rim of the bag is enclosed between the flange of the cap and the upper edge of the collar of the casing. The accuracy of the seating should be sufficient to insure impermeability between the three elements, namely, the cap, the bag and the collar of the casing. Impermeability between cap and bag is generally augmented by an elastic seal located under the flange of the cap in the same way as in aerosol dispensers which do not employ a separate product-aerosol barrier member. Plastic deformation of the material of the bag in contact with the collar is generally relied upon to provide a seal between the bag and the body of the casing. Thus, this is the area which is generally the most critical since the propellant may be inadvertently lost if a sound and reliable seal is not obtained.

The propellant is usually a volatile gas and the material forming the bag is most often a plastic material, but one which is not always elastic or resilient to form and maintain a satisfactory seal. Materials such as polypropylene or poyethylene, or even lightweight metals such as aluminum are frequently employed.

THE PRIOR ART

Various processes have been employed to insure an accurate alignment between the bag and the collar. Thus, bags having cylindrical collars have been produced which are initially introduced into the casing and are then partially withdrawn upwardly so that the cylindrical collar of the bag projects through the collar or neck of the casing. The upper end of the collar of the bag is then flanged and positioned against the collar of the casing.

Another technique suggested by U.K. Pat. No. 1,134,993 introduces a bag equipped with a preformed but uncut flange to the interior of the casing and subsequently withdraws the flange area and shapes the flange to its final form in situ, after which it bears against the collar of the casing.

Still another technique employs a bag with a preformed flange forcibly introduced from the top of the casing to the interior thereof. This method of introduction is unsatisfactory where the bags lack rigidity such as those made of high density polyethylene. In this method, it has been found that there may be permanent deformation in the bag which is particularly harmful if the deformation occurs in the region of the collar and flange where the defect may result in the ultimate loss of product or propellant material. The integrity of the body of the bag must be maintained, otherwise there is the additional risk that the bag will buckle during use and interfere with the discharge valve preventing the user from expelling all of the product contents.

All known processes which rely on the plastic or deformable adaptation of the material of the bag to the metal edge of the casing collar in order to achieve a seal therebetween yield uncertain results and significant and unacceptable numbers of rejects. The integrity of the seal could clearly be improved if there were bags available which had a throat and a rim accurately formed and if in addition a seal could be positioned between the rim of the bag and the collar of the casing.

In the past, the problem of a reliable seal between the bag and the casing has not been solved satisfactorily. Indeed, it has been industrially impossible to place and maintain a supplemental seal on the upper edge of the collar of the casing under the flange of the bag at the manufacturing output rates which are necessary to make the process worthwhile.

The present invention is directed to the solution to the aforementioned problem. It provides on an industrial scale an excellent degree of impermeability for barrier type aerosol dispensers both with respect to the consumer product contained in the bag and the propellant product in the casing outside the bag.

Accordingly, an object of the present invention is a process and apparatus enabling improved impermeability in barrier aerosol containers in the region where the product bag is secured to the outer casing.

The process consists of arranging an annular seal beneath the rim of the bag directly on the upper edge of the collar of the casing and maintaining the seal in position during the crimping step as the cap is applied wherein the seal is pressed between the rim of the bag and the upper edge of the collar of the casing. Thus, during the crimping of the cap, the metal flange of the cap presses in succession the rim of the bag and the seal against the upper edge of the collar of the casing, squeezing the seal between the lower face of the rim of the bag and the upper edge of the collar of the casing. This technique insures a seal of excellent quality and a high degree of impermeablity.

If a removable prefabricated seal is employed, such seal should have an internal diameter approximately equal to the internal diameter of the throat of the casing. The external diameter should be approximately equal to the external diameter of the collar of the casing. The rim of the bag should be dimensioned to include an external diameter slightly less than the external diameter of the seal. The rim of the bag should also be approximately equal to the mean diameter of the upper edge of the collar of the casing. The external diameter of the rim of the bag is thus approximately equal to the diameter of the circle constituting the tangent of the edge of the collar of the casing with the horizontal plane defining the upper part of the casing. Thus, the seal projects beyond the rim of the bag and insures sealing in two areas. The first seal is effected between the rim of the bag and the collar of the casing and is effected by the internal portion of the seal. The second seal occurs between the cap and the casing and is accomplished by the peripheral portion of the seal extending beyond the rim of the bag.

High speed assembly techniques positioning the seal on the collar and the bag within the casing should avoid damaging the rim of the bag. Since the bag generally has a body having a diameter greater than the diameter of the mouth of the casing, the seal must be placed at the level of the rim of the bag between the body of the bag on the one hand, the upper face of the collar on the other hand, and this must be accomplished at relatively high assembly speeds. In addition, the seal must be well centered on the upper edge of the collar when the cap is crimped into position. Thus, the bag with its preformed rim is placed in the cylindrical body of the casing before the formation of the shouldered dome and the collar, all of which is accomplished by shaping the upper cylindrical portion of the casing in accordance with known techniques.

After forming the shouldered dome or attaching a detachable dome, if such is employed, the prefabricated seal is positioned and maintained well centered on the upper edge of the collar of the casing. This step is accomplished by a device in the form of a two-piece seal supporting slide tool which can subsequently open and be withdrawn laterally.

An expandable extractor in collapsed condition is employed to support the bag and is lowered through the seal and its supporting tool into the interior of the bag wherein it is expanded. The rim and a portion of the throat of the bag are then engaged and drawn upwardly through the mouth of the casing passing in succession first through the collar of the casing and secondly through the tool supported seal. To accomplish this end, the rim of the bag must be sufficiently flexible so that the rim may collapse symmetrically and pass through the throat of the casing without damage. The throat of the bag should be of a sufficiently elongated cylindrical form so that after having passed through the collar of the casing and the seal, the collapsed flange may resume its normal rim-like configuration.

The bag supporting expansion tool is then lowered until the rim of the bag rests on the upper edge of the collar of the casing with the seal interposed therebetween. The supporting device for the seal may then be disengaged together with the extractor and both withdrawn leaving the bag suspended in the casing well centered by its rim on the annular seal. The cap is positioned and crimping may then be carried out in accordance with normal process.

As an alternative to a separate prefabricated seal, it is contemplated that a gasket or seal adhesively secured to the upper face of the collar of the casing or under the lower face of the rim or flange of the bag may be employed.

Seals cast in situ may also be employed and may be formed by coating or depositing sealant material in the liquid state on the upper face of the collar or the lower face of the rim or flange of the bag and allowing the same to solidify. Materials for this type of seal may be selected from many available plastics in solution or thermosetting materials which solidify rapidly.

The invention will be more clearly understood by consideration of the examples described hereinafter taken together with the accompanying drawings in which.

Figure 1:
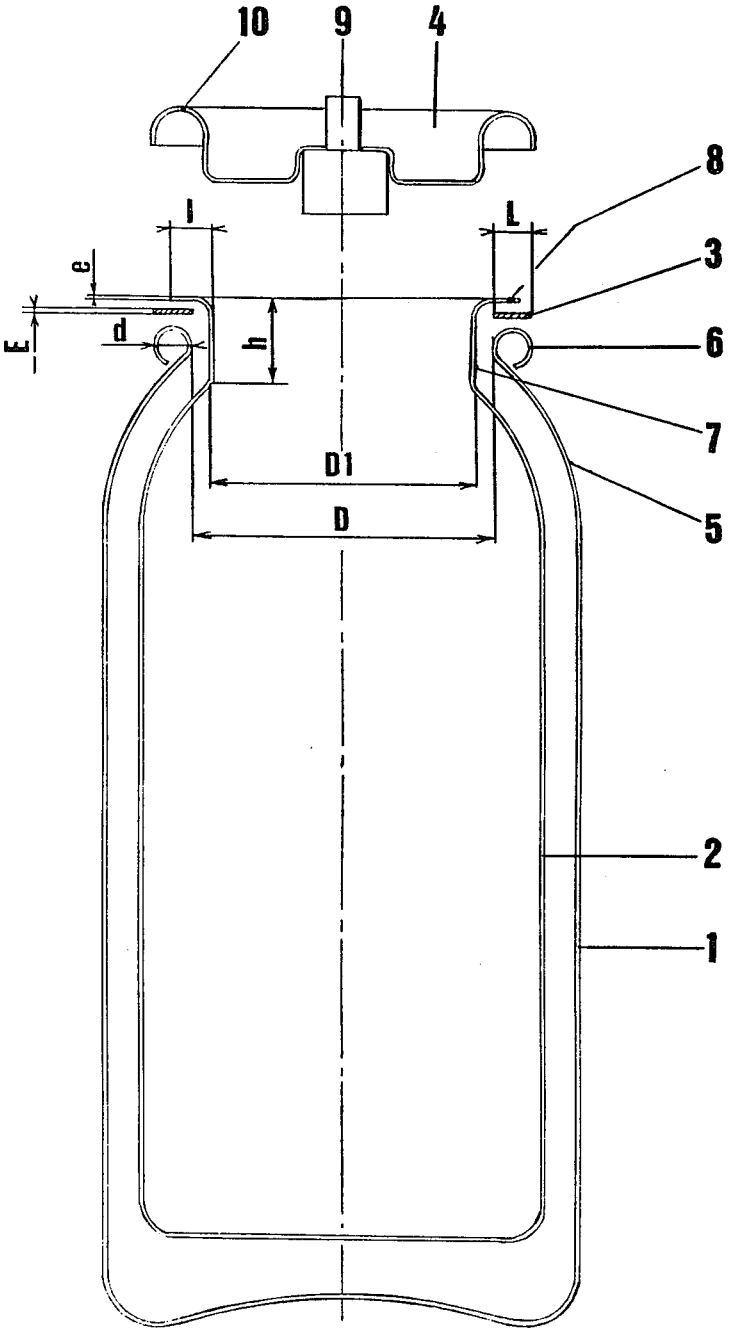
FIG. 1 is a partially exploded elevational section of the component parts of a barrier type aerosol dispenser.

Referring now to FIG. 1, the various elements constituting the aerosol dispenser are shown in exploded view for clarification before final assembly and crimping attachment of the cover or cap. Thus, the rigid casing 1 is illustrated as containing a flexible bag 2. A prefabricated seal 3 is disposed between the collar 6 of the casing 1 and the underside of the radial flange or rim of the bag 2. A valve cap 4 is illustrated in position to be placed on the collar of the casing and crimped thereto during final assembly. The upper portion of the casing 1 includes a dome shaped shoulder 5 terminating in a rolled collar edge 6 defining a mouth having a diameter D. The collar 6 is configured to a diameter *d*.

A flexible bag 2 includes an upper portion shaped to complement that of the interior wall of the casing 1 and is extended by a neck 7 defining a cylindrical passage having an external diameter D1 and a height *h*. This neck terminates in a radial flange or rim 8 having a thickness *e* and *a* width I.

A seal member 3 of elastic material has an approximate thickness E and width L and is positioned between the rolled collar 6 and the flange 8 with the width L being substantially the same as the diameter d of the collar.

A metal cap carries a centrally disposed valve member 9 and includes a peripheral flange 10 overlying the rolled collar 6, the flange 8 and the seal 3.

Figure 2:
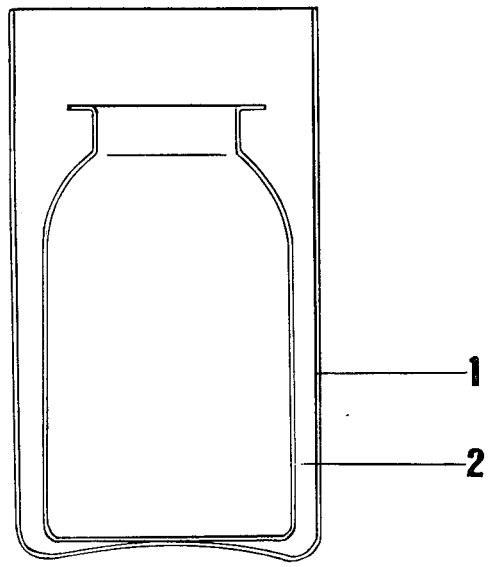
FIG. 2 is an elevational section of the bag illustrated in FIG. 1 positioned within the casing prior to formation of the shouldered dome.
Figure 3:
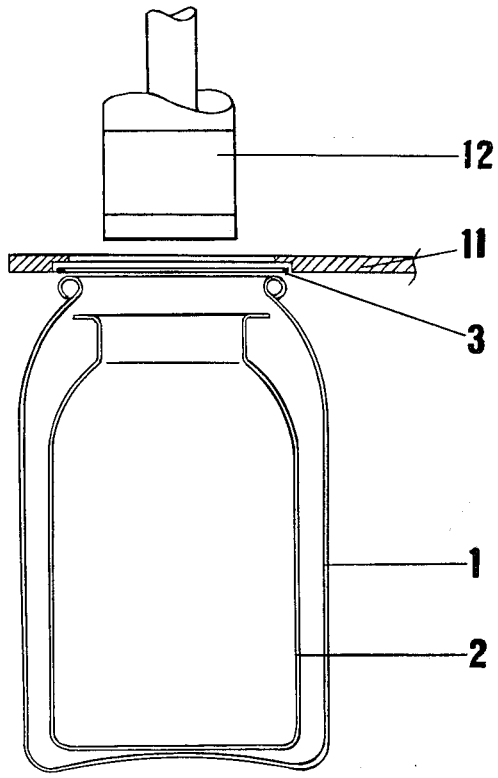
FIG. 3 is an elevational view partly in section of the bag within the formed casing illustrating the prefabricated seal and its supporting device.

Placement of the prefabricated seal 3 is carried out in the following manner:

The flanged bag is introduced into the casing prior to the formation of the shouldered dome as illustrated in FIG. 2 of the drawings. The dome shaped shoulder 5 and the collar 6 defining the mouth of the casing are then formed in accordance with conventional techniques by coining in several operations and edging and rolling the upper end of the cylindrical body. As an alternative, the dome shaped shoulder can be secured as a separate unit by crimping or other conventional technique. The bag 2 is then "trapped" within the body of the casing as illustrated in FIG. 3.

Figure 4:
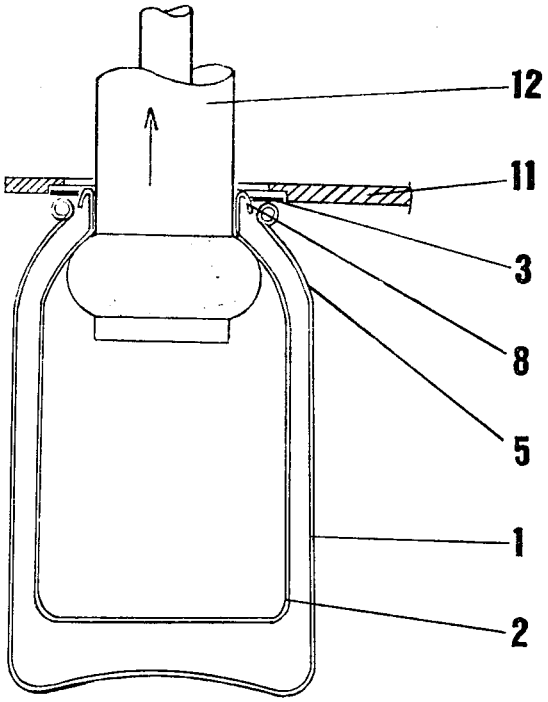
FIG. 4 is an elevational view illustrating the bag partially withdrawn from the casing and passing through the seal and its supporting device.
Figure 5:
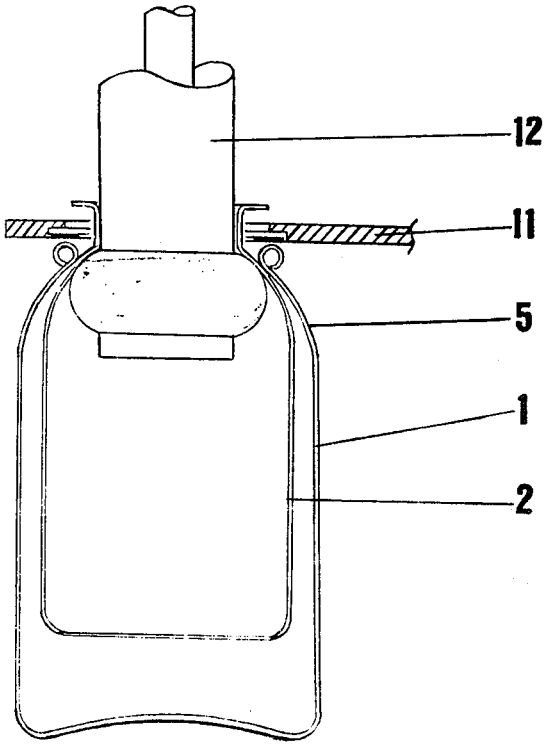
FIG. 5 is an elevational view partly in section of the bag partialy withdrawn through the mouth of the casing and through the seal with its flange or rim extending laterally in the normal position.

The seal member 3 is then positioned over the mouth of the casing is illustrated and maintained in place on the edge of the collar or adjacent thereto by a device in the form of a two-element slide 11. An extractor 12 is also disposed along the vertical axis of the casing and may be introduced into the interior of the bag 2 and the casing. The end of the extractor is dilated to a degree sufficient to contact the interior of the bag and may then be withdrawn upwardly forcing the external surface of the bag into contact with the internal surface of the casing at a point adjacent the mouth of the casing as best seen in FIG. 5. To accomplish this step, the flange or rim of the bag must deflect downwardly since its external diameter is greater than the internal diameter of the mouth of the casing. FIGS. 4 and 5 respectively illustrate the deflected position of the flange or rim and the extended position thereof after partial withdrawal of the bag is accomplished.

The supporting device 11 is in juxtaposition with respect to the mouth of the casing, thus permitting simultaneous withdrawal of the flanged portion of the bag through the annular seal and the mouth of the casing. The seal is thus trapped between the upper face of the rolled edge of the collar and the bottom face of the flange or rim 8 which as resumed its normal radially extended position as illustrated.

Figure 6:
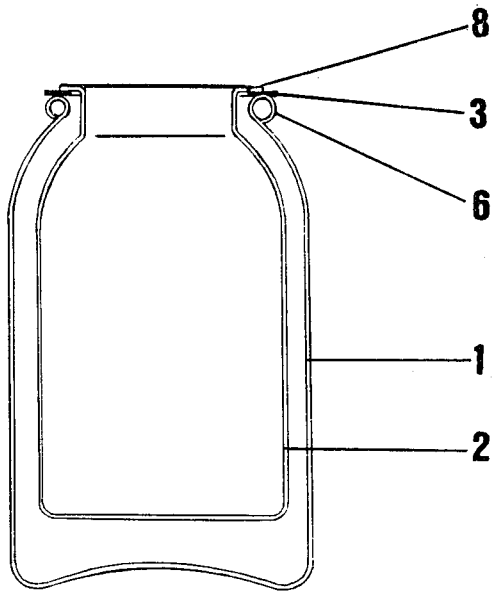
FIG. 6 is an elevational section of the casing, the bag and the seal in stacked relation prior to introduction of the cover.

The extractor may then be lowered depositing the flange 8 of the bag 2 on the collar 6 with the seal 3 interposed therebetween. The extractor and seal supporting device may then be withdrawn and the assembly left substantially as illustrated in FIG. 6.

The cap 4 may then be positioned as illutrated in FIG. 1 and deposited for crimping assembly with the flange 8, seal 3 and rolled collar 6. Thus as seen in FIG. 7 the flange of the cap 4 is crimped to secure the components in assembled relationship insuring impermeability therebetween.

Ordinarily, no separate seal is needed between the bag 2 and the cap 4 since the direct seal obtained by compression of the flexible material from which the bag is fabricated against the inwardly extending portion of the metal cap is generally sufficient.

Figure 7:
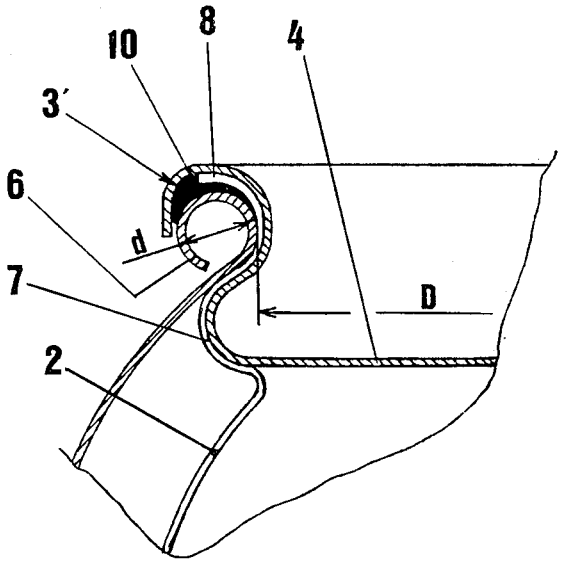
FIG. 7 is an enlarged fragmentary sectional detail of the seal after crimping assembly of the cover, bag and casing.

As best illustrated, in FIG. 7 at 3', a seal, the exterior of which is greater than the largest diameter of the flange or rim 8, will be employed, thus providing a sufficient seal material to ensure impermeability of the joint between the rolled edge 6 and the flange 10 of the cap 4. The method of positioning the various elements for assembly is enhanced by virtue of the special shape of each of the components and thus, the upper portion of the bag has a shape complementary to the internal surface of the shouldered dome on the casing. This shape is maintained when the extractor 12 lifts the bag into contact with the inner surface of the shouldered dome as illustrated in FIG. 5. Moreover, the external diameter of the neck 7 of the bag 2 is sufficiently restricted to permit the passage of the neck with the simultaneous deflection of the flange or rim 8 through the collar 6 of the dome as seen in FIG. 4. Such deflection should, of course, be carried out without permanent deformation of the neck or the flange.

The dimension h of the neck 7 is sufficient to enable the circumference of the flange or rim 8 to disengage and resume its normal configuration after it has passed through the collar of the dome, the seal 3 and the seal supporting device 11 which maintains the seal in the desired position during the assembly step.

In order to accomplish a double seal such as that illustrated in FIG. 7, it is recommended that the various components have the following dimensional relationships:

1. The seal 3 should have an internal diameter approximately equal to the diameter D and width $L = d$ so that the cross-section of the seal roughly corresponds to that of the base of the flange 10 of the cap 4.

2. The flange 8 of the bag should have an external diameter not appreciably greater than $D + d$, if it is desired that the seal 3 extend beyond the flange 8 and insure a sound line of impermeability between the rolled edge of the collar 6 and the flange 10 of the cap 4.

It will be noted that although it would normally be superfluous, it is contemplated to utilize a second seal, possibly one secured to the underside of the flange of the cap, as suggested by the prior art.

As an alternative to a separate prefabricated seal 3, cast seals may, of course, be employed. It is also within the contemplation of this invention that seals adhesively secured as at 13' and 13" illustrated in FIGS. 8 and 9 of the drawings may be employed. Such seals are obtained by coating at least one of the surfaces with sealant material in the liquid state which solidifies after deposition to provide a flexible adherent, solid uniform layer. The sealant may be selected from a number of conventionally employed plastic materials in solution or thermosetting materials.

It will be recognized that in the case of prefabricated seals adhesively attached or seals cast in situ, the use of a holding device 11 becomes unnecessary. Thus, in the example illustrated in FIGS. 8 and 9 where a cast seal 13' is illustrated as adhering to the collar 6 or the cast seal 13" attached to the underside of the flange 8 of the bag, assembly of the various components is significantly simplified and is accomplished substantially as follows:

1. Introduction of the bag 2 into the casing 1 before forming or placing of the shouldered dome 5.
2. Forming or placing the shouldered dome 5 with its rolled edge 5.
3. Applying a coating of liquid material to form a cast seal (or, in the alternative, adhesively securing the seal to the rolled edge 6 of the shouldered dome).
4. Introduction of the extractor 12 to the interior or the bag.
5. Elevation of the bag with the attendant deflection of the flange 8 and extension of the upper portion of the neck 7 through the collar of the casing with radial expansion of the flange 8 to its normal position.
6. Lowering of the extractor depositing the bag on the edge of the collar with the seal 13' interposed between the bottom of the flange and the top of the collar.
7. Positioning of and crimping assembly of the cap on the edge of the shouldered dome.

Figures 8, 9:
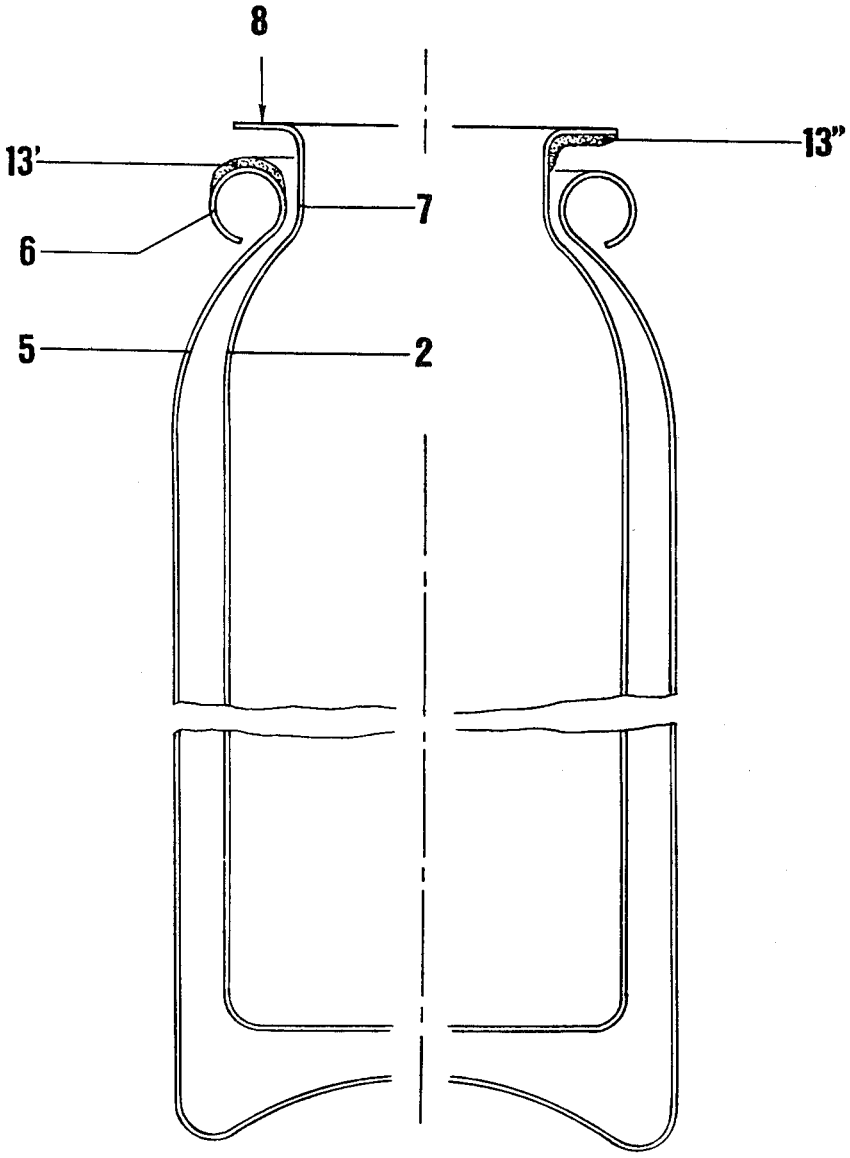
FIG. 8 is an elevational view in half-section of a seal cast in situ or adhesively secured in position on the upper edge of the collar of the casing.
FIG. 9 is an elevational view in half-section of a seal adhesively secured or cast in situ in position on the underside of the flange or rim of the bag.

For cast seals 13" positioned under the lower face of the flange 8 of the bag as shown in FIG. 9, the process for assembling the elements would normally include the following steps:

1. Introduction of the bag into the interior of the casing before formation or positioning of the dome 5.
2. Forming or positioning of the dome 5 and its rolled edge collar 6.
3. Introduction of the extractor 12 into the interior of the bag.
4. Extraction of the flange 8 and the upper portion of the neck 7 through the collar of the casing to a degree sufficient to enable the flange to resume its normal position.
5. Coating the lower face of the flange 8 with seal material 13' while supporting the flange out of contact with the other components.
6. Lowering the extractor 12 and deposition of the flange on the edge of the collar with the seal material interposed therebetween.
7. Positioning and crimping the cap 4 on the collar of the casing.

Obviously, it is equally possible to utilize a similar process to the latter employing a cast seal 13' (FIG. 8) adhering to the upper surface of the collar 6. During step 5 in the preceding example, seal material may be placed on both the edge 6 of the collar and under the flange 8 of the bag as desired.

It should also be noted that in the case where a seal 13' or 13" is made during step 5, while the bag is in the elevated position, the height h of the cylindrical part of the neck 7 may be slightly reduced with respect to the values mentioned above.

Finally, it will be noted that a cast seal 13" adhering under the lower face of the flange 8 may also be made at the end of the manufacturing cycle of the bag prior to the assembly process of the bag 2 within the rigid casing 1.

While several embodiments and alternative techniques of assembly have been described and illustrated hereinbefore, these descriptions and techniques are not intended to limit the scope of the invention, but instead are considered as illustrative examples. Modifications and equivalents of the various parts, steps, procedures and relationships are to be considered within the scope of the appended claims.

I claim:

1. The method of assembling an aerosol dispenser including the steps of:

1. placing a flanged flexible bag within a rigid outer casing,
2. forming a shouldered dome on said casing to define a mouth including an annular collar encircling said mouth,
3. positioning an annular seal above said collar of said mouth,
4. withdrawing the flanged portion of said bag from said casing through said mouth and said seal and positioning said flange and seal in stacked relation on said collar,
5. positioning a cover member above said assembly in overlying relation thereto, and
6. securing said cover to said casing by simultaneously crimping said cover, said flange and said seal to said collar to form an impermeable seal therebetween.

2. The method of claim 1 wherein said seal is formed in situ on said flange before final assembly.

3. The method of claim 1 wherein said seal is formed in situ on said collar before final assembly.

4. The method of claim 1 wherein said seal is adhesively attached to said flange before final assembly.

5. The method of claim 1 wherein said seal is adhesively attached to said collar before final assembly.

* * * * *